United States Patent [19]

Saito

[11] Patent Number: 4,476,910

[45] Date of Patent: Oct. 16, 1984

[54] ROLL-BLIND

[75] Inventor: Yasuji Saito, Chiba, Japan

[73] Assignee: Kabushiki Kaisha Nichibei, Tokyo, Japan

[21] Appl. No.: 345,367

[22] Filed: Feb. 3, 1982

[30] Foreign Application Priority Data

Feb. 10, 1981 [JP] Japan ..... 56-16773
Mar. 18, 1981 [JP] Japan ..... 56-36821

[51] Int. Cl.[3] ..... E06B 9/208
[52] U.S. Cl. ..... 160/291
[58] Field of Search ..... 160/7-9, 160/291-299

[56] References Cited

U.S. PATENT DOCUMENTS

| | | | |
|---|---|---|---|
| 1,268,914 | 6/1918 | Barry et al. | 160/8 |
| 2,031,459 | 2/1936 | Chambless | 160/296 |
| 2,040,301 | 5/1936 | Fay | 160/296 |

*Primary Examiner*—Peter M. Caun
*Attorney, Agent, or Firm*—Toren, McGeady and Stanger

[57] ABSTRACT

A roll-blind including a winding roll for winding up a blind cloth and a coil spring contained in said winding roll to rotate it in the cloth winding-up direction, which comprises a mechanism for reducing the rotating speed of said winding roll at the time of winding up the blind cloth.

5 Claims, 12 Drawing Figures

ROLL-BLIND

BACKGROUND OF THE INVENTION

The present invention relates to a roll-blind.

In general, a roll-blind is so constructed that it is opened or closed by winding up a blind cloth onto a winding roll or unwinding the blind cloth from the winding roll.

Heretofore, the roll-blind employs a coil spring which is contained in the winding roll to continuously apply elastic force to said winding roll to rotate it in the cloth winding-up direction. In such a roll-blind in which the blind cloth is subjected to the action of the elastic force of the coil spring, it is very difficult to stop the blind cloth at a desired lowered position against the action of the coil spring and the adjustment of the elastic force of the coil spring has significant bearing on the operation of the roll-blind.

For example, if the elastic force of the coil spring is excessively strong, the blind cloth is wound up suddenly, so that the blind cloth cannot be regularly wound up onto the winding roll and in some circumstances the blind cloth may become damaged. On the other hand, if the elastic force of the coil spring is excessively small, the blind cloth cannot be fully wound up onto the winding roll, that is, the complete operation of blind cannot be assured.

SUMMARY OF THE INVENTION

It is an object of the present invention to avoid such defect in the roll blind using a coil spring and to provide a roll-blind which is simple in construction and which is reliable and smooth in its operation to wind up or unwind a blind cloth.

In accordance with the present invention there is provided a roll blind which comprises a blind cloth, a winding roll for winding up said blind cloth thereon, a coil spring which acts to constantly rotate said winding roll in the cloth winding-up direction, a stopper for stopping the rotation of said winding roll against the action of said coil spring at any desired position where said blind cloth is lowered, and a speed reducing device for reducing the speed of rotation of said winding roll during said winding roll is rotated in the cloth winding-up direction under the action of said coil spring.

BRIEF DESCRIPTION OF THE DRAWINGS

Now, the invention will be explained with reference to the accompanying drawings which illustrate preferred embodiments of the invention, in which.

DETAILED DESCRIPTION OF THE PREFERRED EMBODIMENTS

Figure 1:
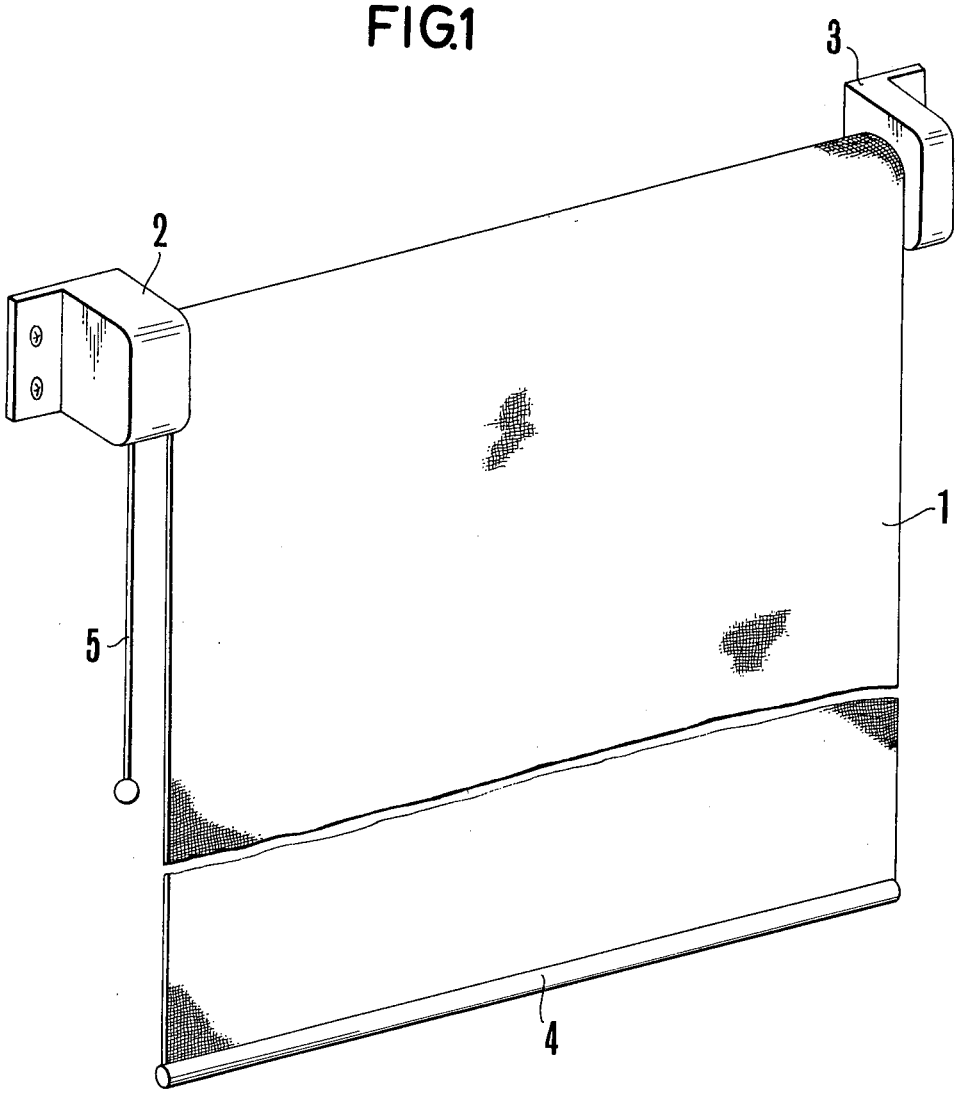
FIG. 1 is a perspective view showing the roll blind according to the first embodiment of the invention.

Firstly, reference will be made to FIG. 1, which illustrates the exterior view of the roll blind. In FIG. 1, 1 is a blind cloth, 2 and 3 are brackets for mounting the roll-blind on a window frame or the like, 4 is a grip portion which is gripped by a hand of an operator when the blind cloth is lowered, and 5 is an operating cord which is pulled downward when the blind cloth is to be wound up.

Figure 2:
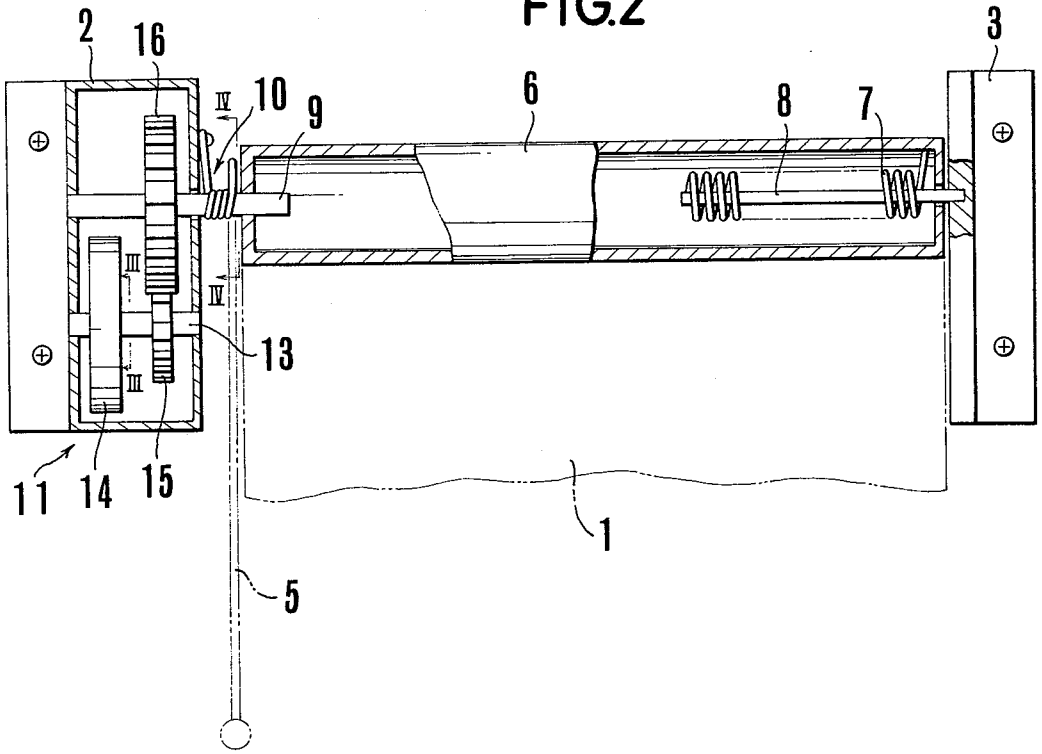
FIG. 2 is an elevational view, partly broken, of the main part of the roll blind shown in FIG. 1.

FIG. 2 is an elevational view, partly broken, of the main part of the roll blind. In FIG. 2, 6 is a winding roll for winding up the blind cloth 1, 7 is a coil spring contained in said winding roll which constantly acts to rotate said winding roll in the cloth winding-up direction, and 8 and 9 are center shafts of said roll. 10 designates a stopper which is arranged on said shaft 9 to stop the rotation of said winding roll 6 in order to stop the blind cloth at a lowered position against the action of said coil spring, and 11 designates a speed reducing device which serves to reduce the speed of rotation of the winding roll 6 when said stopper 10 is released so that the winding roll 6 is rotated in the cloth winding-up direction under the action of the coil spring.

The stopper 10 comprises a clutch spring 12 which is resiliently fastened on the shaft 9 to stop the rotation of said shaft, and the operating cord 5 is connected to the free end of said clutch spring, so that the clutch spring can be released by pulling said operating cord 5 downward.

Figure 3:
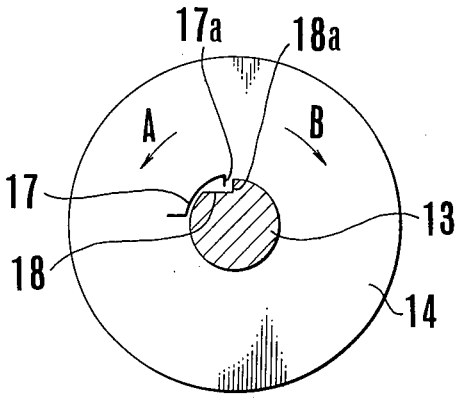
FIG. 3 is a sectional view taken along the line III—III in FIG. 2.
Figure 4:
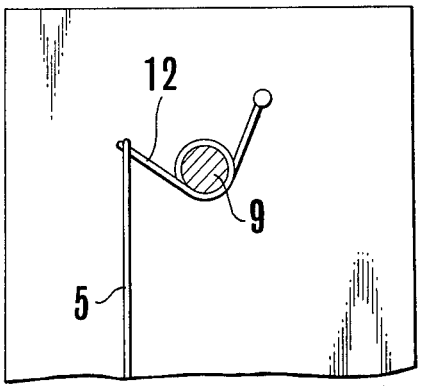
FIG. 4 is a sectional view taken along the line IV—IV in FIG. 2.

According to the embodiment shown in FIG. 2, the speed reducing device 11 comprises a flywheel 14 mounted on a shaft 13 and a gear train including gears 15 and 16 which connects said shaft 13 with the shaft 9. As shown in FIG. 3, the flywheel 14 has a leaf spring 17 fixed in the inside thereof and said leaf spring 17 has an L-shaped projection 17*a* at its end which is adapted to engage in a notch 18 formed on said shaft 13. The leaf spring 17 including the projection 17*a* and the shaft 13 including the notch 18 are so arranged that the flywheel 14 is rotated when the shaft 13 is rotated in the counter-clockwise direction indicated by an arrow A in FIG. 3, that is, in the direction of winding up the blind cloth onto the winding roll 6. More specifically, when the shaft 13 is rotated in the direction indicated by the arrow A, in FIG. 3, the side 18*a* of the notch 18 formed on the shaft 13 comes into engagement with the projection 17*a*of the leaf spring 17 fixed in the flywheel 14, so that the rotation of the shaft 13 is transmitted to the flywheel 14, which is rotated in the same direction. On the other hand, when the shaft 13 is rotated in the clockwise direction indicated by an arrow B, that is, in the direction of lowering the blind cloth, the projection 17*a* of the leaf spring 17 does not come into engagement with the side 18*a*, so that the rotation of the shaft 13 is not transmitted to the flywheel 14.

Now the operation of the roll-blind as described above will be explained.

When it is desired to lower the blind cloth 1, the grip portion 4 of said cloth is gripped and pulled in the downward direction. The winding roll 6 is rotated thereby, and the rotation of this winding roll 6 serves to energize the coil spring 7 contained in the winding roll 6. When the blind cloth is lowered to a desired position and the pulling operation of the grip portion 4 is stopped, the blind cloth is held at the desired lowered position because the rotation of the shaft 9 of the winding roll 6 in the opposite direction is arrested by the clutch spring 12.

When it is desired to raise the blind, the operating cord 5 attached to the end of the clutch spring 12 is pulled in the downward direction. Then the clutch spring 12 is loosened on the shaft 9, so that the stopper 10 is released and the winding roll 6 is rotated under the action of the coil spring 7, thereby winding up the blind cloth 1 thereon.

During the winding-up operation, the rotation of the gear 16 fixedly mounted on the shaft 9 is transmitted to the gear 15 fixedly mounted on the shaft 13, and thus the flywheel 14 is rotated. Accordingly, the resilient force of the coil spring 7 is stored in the flywheel 14, which starts its rotation in smooth manner under the action of said resilient force. Accordingly, the winding roll 6 makes smooth rotation, whereby the blind cloth can be wound up onto the winding roll in smooth manner.

When the blind cloth 1 has been completely wound up onto the winding roll 6, the rotation of the shaft 9 is stopped and consequently the rotation of the shaft 13 on which the flywheel 14 is mounted is also stopped at the same time. At this time, the flywheel 14 still tends to continue its rotation under the action of inertia. However, such rotation of the flywheel is not transmitted to the shaft 13 because the flywheel rotates in such direction that the clutching engagement between the leaf spring 17 and the shaft 13 is released, and the flywheel stops its rotation after a few rotations.

It will be understood that according to the construction of the roll-blind as shown in FIGS. 1–4 the blind cloth can be stopped at any desired position and furthermore smooth winding-up operation of the blind cloth is produced while the resilient force of the coil spring is effectively utilized, because of including the flywheel which acts to produce smooth rotation of the winding roll. Furthermore, at the time of lowering the blind cloth, the blind cloth can be operated by applying relatively small force to pull the blind cloth in the downward direction, since the flywheel is isolated from the winding roll during lowering of the blind cloth.

Figure 5:
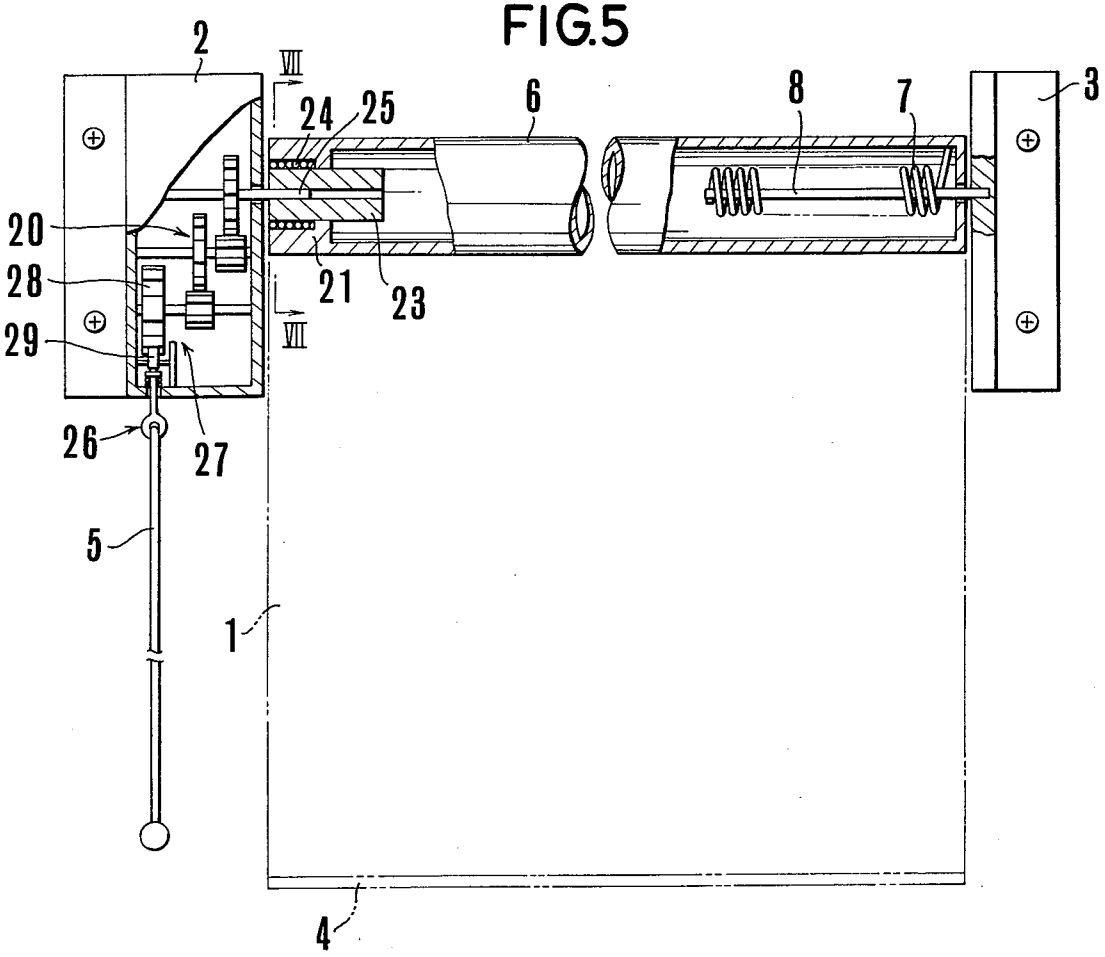
FIG. 5 is an elevational view, partly broken, of the roll blind according to the second embodiment of the invention.
Figure 6:
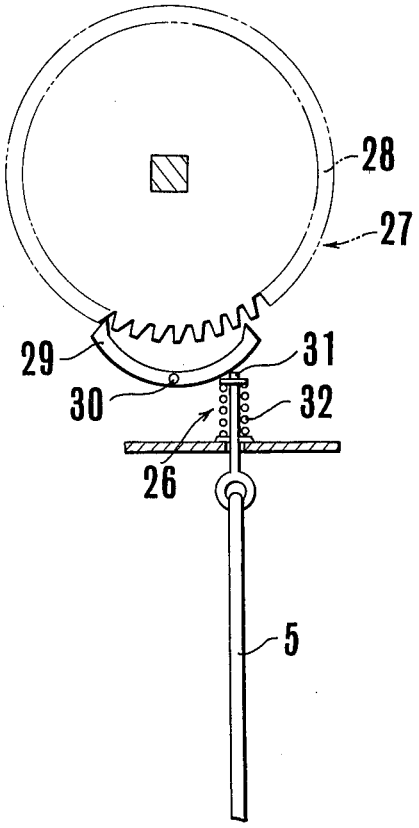
FIG. 6 is an elevational view of a balance wheel mechanism used in FIG. 5.
Figure 7:
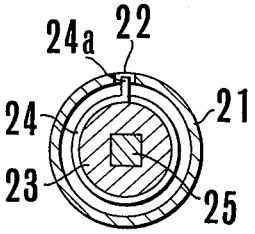
FIG. 7 is a sectional view taken along the line VII—VII in FIG. 5.

FIGS. 5, 6 and 7 illustrate the second embodiment of the present invention. In these figures, the parts same as those shown in FIG. 2 are indicated by the same reference numerals and the detailed explanation thereof is omitted. FIGS. 5 and 6 show a speed reducing device consisting of a balance wheel mechanism 27 which is connected to one of the center shafts of the winding roll 6 driven by the resilient force of the coil spring 7 and which acts to hold the rotation of said winding roll at a low and constant speed. As shown in FIG. 7, the winding roll 6 is formed at its one end 21 with a slit 22, in which is engaged one end 24*a* of a one-way clutch spring 24 wound on a shaft 23 of said winding roll. The shaft 23 is connected through a gear train 20 with the balance wheel mechanism 27 which constitutes the speed reducing device, and the rotation of this shaft is normally arrested by a stopper 26.

The one-way clutch spring 24 which is arranged between the shaft 23 (fixedly connected with the center shaft 25) and the end of the winding roll 6 allows to pull the blind cloth at high speed in the downward direction, independently of the balance wheel mechanism 27 while the blind is lowered.

As shown in FIG. 6, the balance wheel mechanism 27 comprises a ratchet wheel 28 and a pawl member 29 which is supported at its center by a pivot axis 30 for rocking movement therearound and is adapted to alternately engage at its opposite ends with the teeth of said ratchet wheel. The stopper 26 comprises a pawl lifting member 31 which is arranged at one end of said pawl member 29 to upwardly urge said end of the pawl member 29 to stop the rocking movement thereof. Said pawl lifting member 31 is normally biased in the upward direction under the action of a coil spring 32 and can be lowered against the action of said coil spring by pulling an operating cord 5 in the downward direction.

Now the operation of the above roll-blind will be explained.

When the grip portion 4 of the blind cloth is pulled downward, the winding roll 6 is rotated and the blind cloth 1 is lowered. The pawl member 29 of the balance wheel mechanism is held at its one end in engagement with the ratchet wheel 28 by the pawl lifting member 31, so that the balance wheel mechanism is held in inactive state. Since the one-way clutch spring 24 exists between the center shaft 25 and the end of the winding roll 6 (see FIG. 6), the winding roll 6 can rotate, independently of the balance wheel mechanism which is now held in inactive state, so that the blind cloth can be lowered at any desired speed. When the blind cloth is lowered to any desired position, the pulling of the grip portion 4 of the blind cloth is stopped, whereby the winding roll 6 becomes fixedly connected with the shaft 25 through the one-way clutch spring 24, and thus the blind cloth becomes held at this position.

When it is desired to raise the blind, the operating cord 5 is pulled downward. Then, the lifting member 31 is lowered against the action of the coil spring 32, thereby releasing the pawl member 29. Accordingly, the winding roll 6 starts its rotation in the cloth winding-up direction. At the same time, the ratchet wheel 28 starts its stepwise rotating movement with the rocking movement of the pawl member 29, and thus the winding roll 6 rotates at a constant and low speed in the cloth winding-up direction, thereby smoothly raising the blind cloth. When the operation of the cord 5 is stopped, the rocking movement of the pawl member 29 is stopped at once and thus the blind cloth is stopped at the desired position.

It will be understood that FIGS. 5–7 show a construction of the roll-blind which includes means for storing the resilient force of the coil spring 7 in order to allow the smooth upward movement of the blind cloth, wherein the means for storing the resilient force of the coil spring consists of the balance wheel mechanism connected to the center shaft of the cloth winding roll, whereby the winding-up operation of the blind cloth can be effected at a constant and low speed and the blind cloth can be stopped at any desired position by stopping the operation of said balance wheel mechanism by pulling the operating cord downward. Moreover, this construction allows to lower the blind cloth to any desired position at high speed because the one-way clutch spring acts to cut off the balance wheel mechanism from the winding roll and consequently the blind cloth can be lowered independently of the balance wheel mechanism during the cloth lowering operation.

Figure 9:
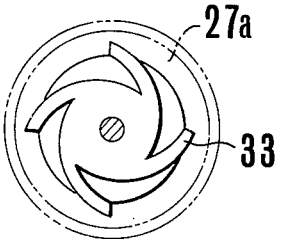
FIG. 9 is a side view of a ratchet mechanism used in the stopper mechanism shown in FIG. 8.
Figure 10C:
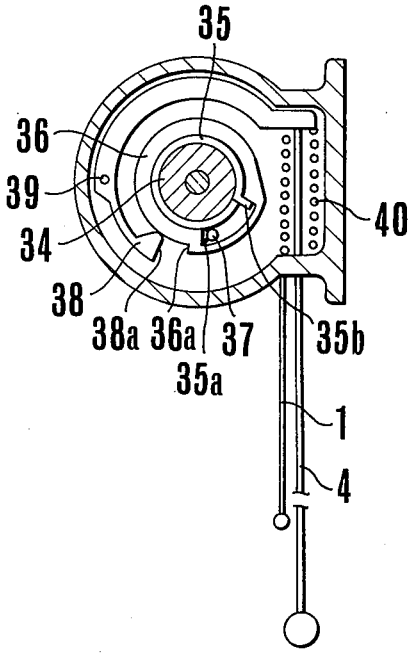
FIGS. 10(*a*), (*b*) and (*c*) are sectional views showing the successive steps of the operation of the mechanism shown in FIG. 8.
Figure 8:
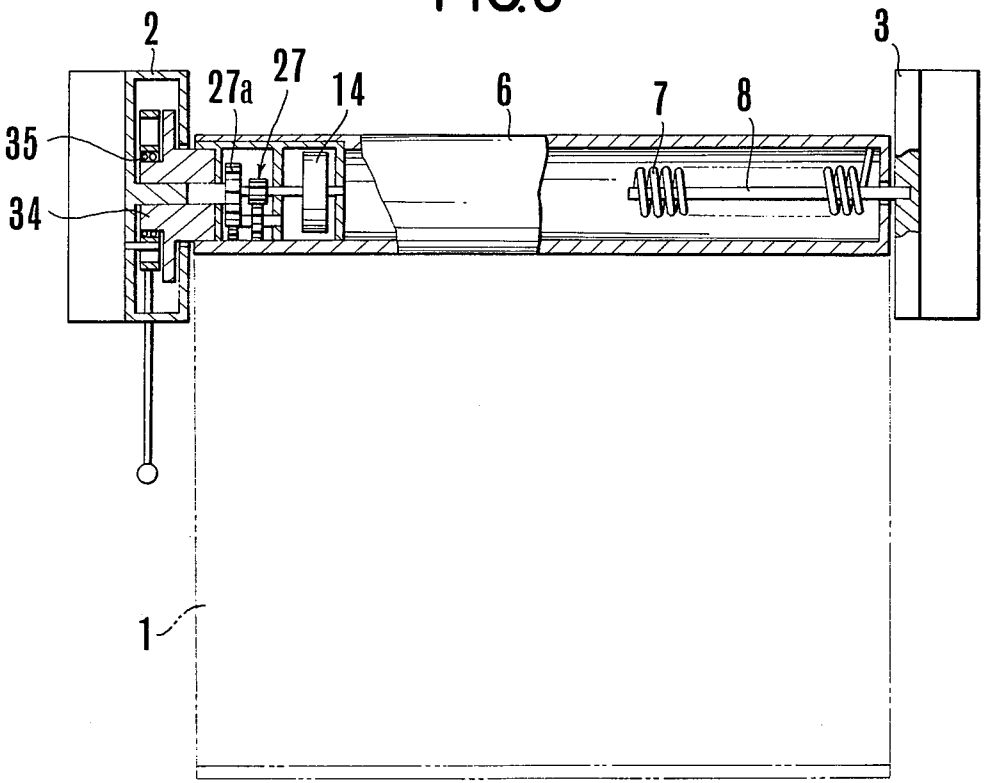
FIG. 8 is an elevational view, partly broken, of a modified form of a stopper mechanism.
Figure 10A:
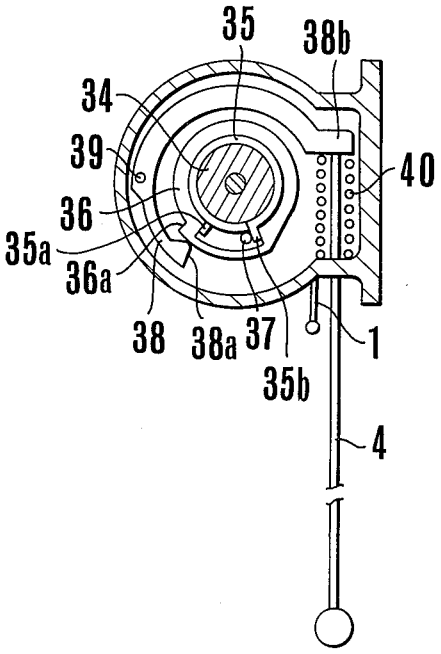
Figure 10B:
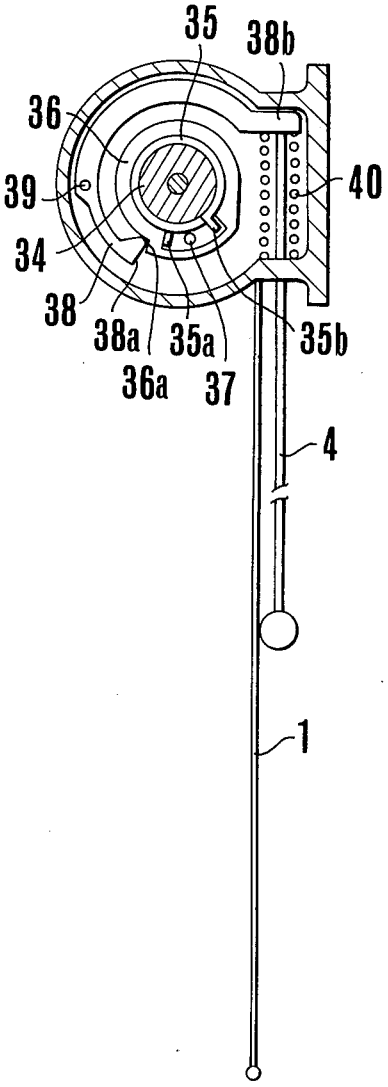

FIGS. 8, 9 and 10 illustrate a modified form of the stopper mechanism. The roll-blind shown in FIGS. 8, 9 and 10 includes a speed reducing device 27 and a flywheel 14 which are arranged to produce the rotation of the winding roll 6 at a smooth and constant speed during the cloth winding-up operation. In order to allow the rapid lowering of the blind cloth during the blind lowering operation, a ratchet mechanism 33 is included in a gear 27*a* of the speed reducing device 27, and the speed reducing device 27 and the flywheel 14 are so arranged that they are effective only during the blind winding-up operation.

The stopper mechanism includes a clutch shaft 34, a spring clutch 35 wound on said shaft and a clutch ring 36 arranged on said spring clutch. The spring clutch 35 is formed at its opposite ends with projections 35*a* and 35*b*, which are arranged to come into engagement with a pin 36 which projects inwardly of the case. The clutch ring 36 has a step portion 36*a* formed on the outside thereof, and a stopper member 38 is arranged around the clutch ring 36 so that it can come into engagement with said stop portion 36*a* to stop the rotation of said clutch ring in the cloth winding-up direction. The stopper member 38 is pivotally mounted on a pivot axis 39 in the case and it has a forward end 38*a* which is arranged to engage with the step portion 36*a* and another end 38*b* to which the operating cord 5 is connected. A coil spring 40 is arranged between the end 38*b* of the stopper member 38 and the case in order to normally rotate said stopper member 38 into engagement with the step portion 36*a* to stop the rotation of the clutch ring 36 in the cloth winding-up direction. The clutch device including the clutch shaft 34, the spring clutch 35 and the clutch ring 36 functions to loosen the clutch spring 35 to allow free rotation of the clutch shaft 34 when the blind cloth 1 is pulled downward, to tighten said spring clutch 35 when the clutch ring 36 is stopped by the stopper member 38, and to loosen said spring clutch 35 to allow rotation of the clutch shaft 34 in the cloth winding-up direction when the stopper member 38 is released from the step portion to allow rotation of the clutch ring 36.

FIG. 10(*a*) shows the state of roll-blind where the blind cloth 1 is completely wound up onto the winding roll. When the blind cloth 1 is pulled downward, the clutch shaft 34 is rotated together with the rotation of the winding roll 6 in the counterclock direction in FIG. 10(*a*). By the rotation of the clutch shaft 34, the projection 35*a* of the spring clutch 35 wound around the shaft 34 comes into engagement with the pin 37 and then the spring clutch 35 is loosened to allow free rotation of the shaft 34 so that the blind cloth 1 can be lowered. When the blind cloth 1 is lowered to any desired position and the lowering of the cloth is stopped, the blind cloth tends to be wound up onto the winding roll under the action of the coil spring 7. However, the step portion 36*a* of the clutch ring 36 comes into engagement with the end 38*a* of the stopper member 38 and the pin 37 cannot push the projection 35*a* of the spring clutch 35 any more, so that the spring clutch becomes effective. Under such condition, the blind cloth 1 is stopped at the desired position, as shown in FIG. 10(*b*).

When the operating cord 5 is pulled downward in order to wind up the blind cloth onto the winding roll, the end 38*a* of the stopper member 38 is released from the engagement with the step portion 36*a* of the clutch ring 36 and thus the clutch ring is moved into the inside of the stopper member 38. The clutch ring 36 continues its rotation until the projection 35*b* of the spring clutch 35 comes into engagement with the pin 37, and then the spring clutch 35 is loosened by said pin 37 to allow rotation of the shaft 34 under the action of the coil spring 7, with the result that the blind cloth 1 is wound up onto the winding roll, as shown in FIG. 10(*a*).

According to the roll-blind as shown in FIGS. 8, 9 and 10, the winding roll is rotated at a constant and stable speed during the blind winding-up operation, even if there are variations in width and height of the roll-blind and at the time of cloth winding operation the blind cloth can be raised to its completely wound up position only by releasing the stopper member at the start of the operation.

The present invention has been explained with reference to the drawings which illustrate preferred embodiments of the invention. However, it will be understood that modifications and changes may be made to the embodiments within the scope of the invention as defined in the claims.

What is claimed is:

1. A roll-blind comprising a blind cloth, a winding roll for winding up said blind cloth thereon, a coil spring for constantly rotating said winding roll in its cloth winding-up direction, a stopper for stopping the rotation of said winding roll against the action of said coil spring at any desired position where said blind cloth is lowered, and a speed reducing device for reducing the speed of rotation of said winding roll due to the action of said coil spring while said winding roll is being continuously rotated in the cloth winding-up direction under the action of said coil spring so that the winding-up operation continues in a smooth and reliable manner.

2. A roll-blind according to claim 1 wherein said winding roll includes two axially aligned center shafts, the speed reducing device comprises a flywheel which is connected with one of the center shafts of the winding roll through a clutch which transmits the rotation of the winding roll to said flywheel only during the rotation of the winding roll in its cloth winding-up direction.

3. A roll-blind according to claim 1 wherein said winding roll includes two axially aligned center shafts, the speed reducing device comprises a reduction gear train which is connected with one of the center shafts of the winding roll through a clutch which transmits the rotation of the winding roll to said gear train only during the rotation of the winding roll in its cloth winding-up direction.

4. A roll-blind according to claim 1 wherein the speed reducing device comprises a balance wheel mechanism which is connected with one of the center shafts of the winding roll through a clutch which transmits the rotation of the winding roll to said balance wheel mechanism only during the rotation of the winding roll in its cloth winding-up direction.

5. A roll-blind comprising a blind cloth, a winding roll for winding up said blind cloth thereon, a coil spring for constantly rotating said winding roll in its cloth winding-up direction, a stopper for stopping the rotation of said winding roll against the action of said coil spring at any desired position where said blind cloth is lowered, a speed reducing device for reducing the speed of rotation of said winding roll while said winding roll is rotated in the cloth winding-up direction under the action of said coil spring, comprising a stopper mechanism including a clutch shaft rotating with said winding roll, a spring clutch wound on said clutch shaft, a clutch ring arranged around said spring clutch and having a step portion formed on the outside thereof and a stopper member arranged to come into engagement with said step portion to stop the rotation of said clutch ring in the cloth winding-up direction, which are so arranged as to loosen said spring clutch to allow free rotation of said clutch shaft during the blind cloth is lowered, to tighten said spring clutch to stop the clutch shaft when the clutch ring is stopped by said stopper member and to loosen said spring clutch to allow rotation of the clutch shaft in the cloth winding-up direction when said stopper member is released to allow rotation of the clutch ring.

* * * * *